US008936193B2

(12) United States Patent
McHale et al.

(10) Patent No.: US 8,936,193 B2
(45) Date of Patent: Jan. 20, 2015

(54) OPTICAL DEVICE INCLUDING AN ADAPTIVE LIFE-CYCLE BALLISTICS SYSTEM FOR FIREARMS

(71) Applicant: TrackingPoint, Inc., Austin, TX (US)

(72) Inventors: John Francis McHale, Austin, TN (US); John Hancock Lupher, Austin, TX (US)

(73) Assignee: TrackingPoint, Inc., Pflugerville, TX (US)

( * ) Notice: Subject to any disclaimer, the term of this patent is extended or adjusted under 35 U.S.C. 154(b) by 11 days.

(21) Appl. No.: 13/712,931

(22) Filed: Dec. 12, 2012

(65) Prior Publication Data

US 2014/0158763 A1 Jun. 12, 2014

(51) Int. Cl.
*F41G 3/12* (2006.01)
*F41A 19/01* (2006.01)

(52) U.S. Cl.
CPC .. *F41G 3/12* (2013.01); *F41A 19/01* (2013.01)
USPC ..... 235/417; 42/1.01; 42/1.03; 42/72

(58) Field of Classification Search
USPC ..... 235/417; 42/1.01, 1.03, 72
See application file for complete search history.

(56) References Cited

U.S. PATENT DOCUMENTS

| | | | | |
|---|---|---|---|---|
| 5,349,853 | A * | 9/1994 | Oehler | 73/167 |
| 6,269,581 | B1 | 8/2001 | Groh | |
| 7,210,392 | B2 * | 5/2007 | Greene et al | 89/41.03 |
| 7,856,750 | B2 | 12/2010 | Sammut et al. | |
| 2003/0101891 | A1 * | 6/2003 | Amick | 102/514 |
| 2008/0010891 | A1 * | 1/2008 | Cole | 42/130 |
| 2008/0188314 | A1 * | 8/2008 | Rosenblum | 463/52 |
| 2009/0253103 | A1 * | 10/2009 | Hogan, Jr. | 434/24 |
| 2010/0251586 | A1 * | 10/2010 | Packer et al. | 42/1.01 |
| 2011/0154706 | A1 * | 6/2011 | Harper | 42/1.03 |
| 2012/0131828 | A1 * | 5/2012 | August et al. | 42/1.02 |
| 2012/0285064 | A1 * | 11/2012 | Houde-Walter | 42/72 |
| 2014/0231515 | A1 * | 8/2014 | Bay | 235/417 |

* cited by examiner

*Primary Examiner* — Allyson Trail
(74) *Attorney, Agent, or Firm* — Cesari & Reed, LLP; R. Michael Reed

(57) ABSTRACT

A method includes determining a shot count within an optical device coupled to a firearm. The shot count corresponds to a number of shots taken using the firearm. The method further includes determining a muzzle velocity parameter from a life-cycle profile of the firearm based on the shot count as an input into a ballistics solution.

20 Claims, 3 Drawing Sheets

OPTICAL DEVICE INCLUDING AN ADAPTIVE LIFE-CYCLE BALLISTICS SYSTEM FOR FIREARMS

FIELD

The present disclosure is generally related to optical devices for use with firearms, and more particularly, to optical devices that are configured to track a shot count and to use the barrel total shot count to compensate for wear of a barrel of the firearm by adjusting the ballistic solution based on the shot count.

BACKGROUND

In general, the term "ballistics solution" refers to a calculated launch point for a projectile, such as a bullet, discharged from a gun. One parameter that is used to calculate the impact point is the "muzzle velocity", which refers to the speed at which the projectile leaves the end of the barrel of the gun.

Each time a gun is fired, the bullet travels the length of the barrel, causing minute changes to the inner walls of the barrel. Such changes may accumulate to alter the barrel, which changes ultimately may affect the shooting accuracy of the firearm. Shooters and manufacturers have varying views about when a barrel should be replaced or taken out of service due to the wear a barrel has experienced from the firing of a weapon.

SUMMARY

In an embodiment, a method includes determining a shot count within an optical device coupled to a firearm. The shot count corresponds to a number of shots taken using the firearm. The method further includes determining a muzzle velocity parameter from a life-cycle profile of the firearm based on the shot count as an input into a ballistics solution.

In another embodiment, an optical device configured to be mounted to a firearm includes a processor and a memory accessible to the processor. The memory is configured to store a shot count corresponding to a number of times the firearm has been discharged and a life-cycle profile corresponding to the firearm. The memory is accessible to the processor and includes instructions that, when executed, cause the processor to determine the shot count and to determine a muzzle velocity parameter of the firearm from the life-cycle profile based on the shot count as an input into a ballistics solution.

In still another embodiment, a rifle scope includes a processor and a memory accessible to the processor that is configured to store a shot count. The memory is configured to store instructions that, when executed, cause the processor to determine the shot count, determine a muzzle velocity parameter from a life-cycle profile in response to determining the shot count, and provide the muzzle velocity parameter as an input to a ballistic solution.

BRIEF DESCRIPTION OF THE DRAWINGS

In the following discussion, the same reference numbers are used in the various embodiments to indicate the same or similar elements.

DETAILED DESCRIPTION OF ILLUSTRATIVE EMBODIMENTS

Embodiments of an optical device and methods are described below that can be used in connection with a firearm. The optical device is configured to detect and count each shot fired using the firearm, to determine a muzzle velocity parameter corresponding to the current shot count, and to provide the muzzle velocity parameter as an input to a ballistic solution for the firearm. The muzzle velocity parameter may be the muzzle velocity that corresponds to a particular shot count, a change in muzzle velocity that corresponds to the particular shot count, or a value calculated from one of the muzzle velocity and the change in the muzzle velocity. In an embodiment, the optical device includes a processor configured to calculate the ballistics solution using the muzzle velocity parameter. In one embodiment, the processor may retrieve the muzzle velocity parameter from a stored lookup table. In another embodiment, the processor may calculate the muzzle velocity parameter using a curve-fitting algorithm configured to match a life-cycle profile of the firearm.

Figure 1:
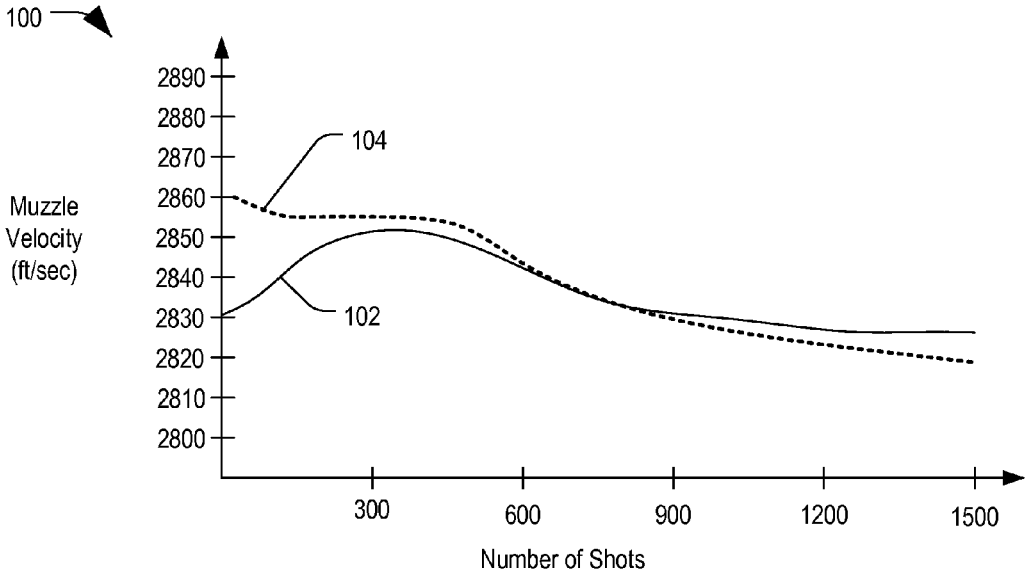
FIG. 1 is a graph of an example of muzzle velocity versus number of shots representing a life-cycle profile of a barrel of a particular firearm.

FIG. 1 is a graph 100 of an example of muzzle velocity versus number of shots representing a life-cycle profile of a barrel of a particular firearm. In general, each type of gun barrel may have its own life-cycle during which the internal profile of the gun barrel may change from shot to shot, resulting in changes in the muzzle velocity. Over a large number of shots, these gradual changes to the internal profile of the barrel after each shot may eventually lead to changes to the shooting accuracy of the firearm.

Graph 100 depicts a first life cycle profile 102 generated by measuring the muzzle velocity for multiple guns of the same type, where the barrels were made using the same materials and the same process. Within a batch of such guns, the muzzle velocity variations tend to follow a characteristic pattern that increases from an initial velocity and then decreases, decaying almost exponentially. The initial increase in the muzzle velocity may be attributable to initial widening of the interior diameter of the muzzle due to minute scrapings by the bullet, reducing the friction between the bullet and the muzzle. Combustion of the gun powder causes pressure to form behind the projectile, accelerating the projectile through the barrel. Over time, the shot-by-shot expansion of the barrel's interior diameter leads to a slight decrease in the muzzle velocity, in part, because such changes reduce the pressure behind the projectile. Life cycle profile 102 may represent an average muzzle velocity determined by testing multiple firearms of the same type.

Profile 104 corresponds to a different type of gun having a different barrel shape and/or formed using a different process or different materials. Profile 104 has a muzzle velocity that decreases at first, then plateaus for a number of shots, and then decreases again. Profile 104 may reflect a different manufacturing process, different materials, different types of ammunition, or any combination thereof.

In general, each gun type may have its own life-cycle profile. Further, other types of weapons, such as air guns, may also have a life-cycle profile that can be determined through multiple shots. The life-cycle profile includes a muzzle velocity parameter that can be retrieved based on a shot count and provided as an input to a ballistics solution. Within a digital optical device, which can be mounted to a rifle, an air gun, or another type of firearm, the corresponding life-cycle data may be stored in a memory and the device may be configured to count the number of shots taken and to use the life-cycle profile to determine, based on the shot count, a muzzle velocity parameter as an input to a ballistics solution. The ballistics solution represents a calculated impact location for the projectile based on a large number of variables. Ballistics calculations are known to those skilled in the art, and the muzzle velocity parameter factors into a bullet drop portion of the ballistics solution.

To produce a life-cycle profile for a given firearm, one or more representative samples of the firearm may be fired a suitable number of times for characterizing the gradual change to the muzzle velocity with each shot. Multiple representative samples of the given firearm may be fired to produce a life-cycle profile by averaging the results. In a particular example, a particular caliber of firearm that is produced and sold by different manufacturers may be tested to determine a life-cycle profile for the particular type of firearm. In some embodiments, the life-cycle profile may be specific to a particular caliber of firearm from a particular manufacturer. In other embodiments and/or for some particular calibers of firearms, the life-cycle profile may be generalized to represent all similar caliber firearms of the same type (e.g., rifle, etc.). One possible example of a method of determining a life-cycle for a plurality of firearms is described below with respect to FIG. 2.

Figure 2:
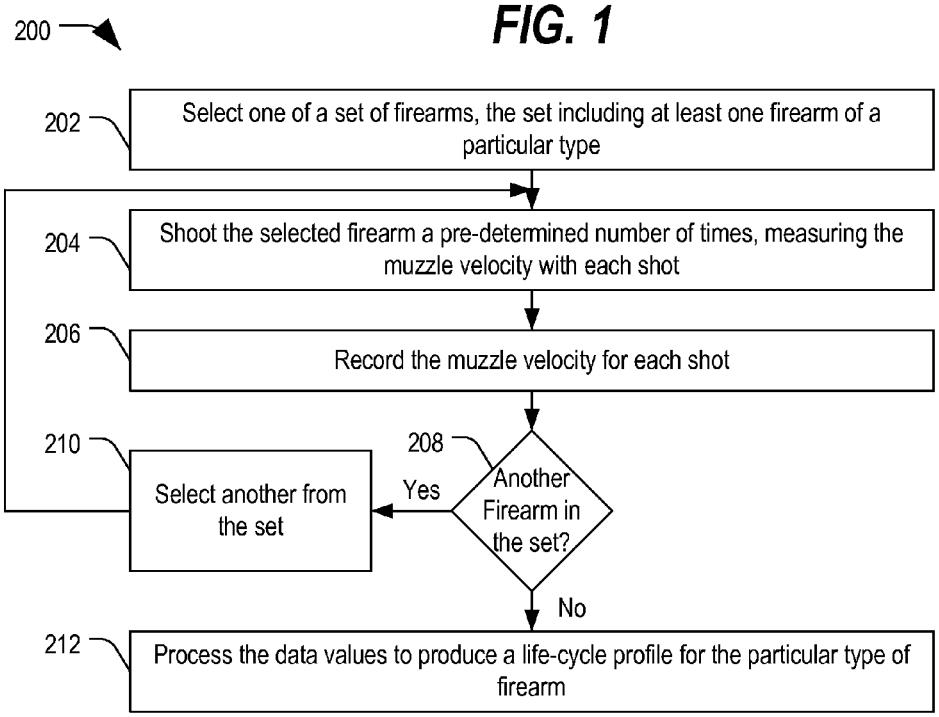
FIG. 2 is a flow diagram of a method of producing a life-cycle profile of a barrel of a particular firearm.

FIG. 2 is a flow diagram of a method 200 of producing a life-cycle profile of a barrel of a particular firearm. At 202, one of a set of firearms including at least one firearm of a given type is selected. In one embodiment, the plurality of firearms can be a representative sample of several firearms of the same type and manufactured by the same company.

Advancing to 204, the user fires the selected firearm a pre-determined number of times, measuring the muzzle velocity with each shot. In an example, a gun chronograph can be used to measure the velocity of the projectile. The pre-determined number of shots may be specified by a gun manufacturer. In an embodiment, the number of shots represents a number suitable to characterize the life-cycle of the barrel of the firearm, where the term "life-cycle" refers to the useful life of such barrel. In an example, the gun manufacturer may specify an expected life span for the barrel of approximately 1,500 shots, in which case the pre-determined number may be set to correspond to the expected life span (i.e., 1,500 shots). In another example, the gun manufacturer may specify 10,000 shots, in which case the pre-determined number of shots may be set at 10,000.

Continuing to 206, the muzzle velocity is recorded for each shot. In an example, the muzzle velocity is recorded in a memory. Advancing to 208, if there is another firearm in the plurality of firearms of the particular type that has not yet been tested, the method 200 continues to 210 and another of the set of firearms is selected. The method 200 then returns to 204 and the selected one is shot a pre-determined number of times, measuring the muzzle velocity with each shot.

At 208, if there is no other firearm in the set of firearms of the particular type to be tested, the method 200 proceeds to 212 and the data values are processed to produce a life-cycle profile for the particular type of firearm. In one example, the data values are processed by storing them in memory in conjunction with their corresponding shot number. In another example, multiple measurements from different ones of the plurality of firearms may be processed by averaging to determine an average muzzle velocity corresponding to a particular shot, which average and shot number can be stored in the memory. In still another example, the measurements may be processed by calculating a change in muzzle velocity from shot to shot and storing the change in memory. The life-cycle profile can be accessed to determine, based on a shot count, a muzzle velocity parameter that can be provided as an input a ballistics solution.

In the above-example, multiple representative samples of a given type of firearm from the same manufacturer may be tested to produce an average of the muzzle velocities for each shot. These average values may be used to produce an average life-cycle profile for the given type of firearm. Further, multiple firearms of the same general type from different manufacturers may also be fired to gather corresponding data points. To the extent that such additional firearms produce similar data values, it may be possible to incorporate that data into the life-cycle profile to produce an average life-cycle profile that is representative of a particular type of firearm, regardless of the manufacturer. Further, such life-cycle profiles may be produced for a wide variety of firearm types and or for each particular firearm, such that a digital optical device (such as a rifle scope) may be configured with the particular life-cycle profile for the firearm to which it is attached, without having to alter the hardware. In an example, the life-cycle profile information may be stored in a memory within the rifle scope, and a processor of the rifle scope may access the life-cycle profile information for each shot to determine a muzzle velocity and to provide a muzzle velocity parameter as an input to a ballistics solution.

While the life-cycle profile may be determined for a variety of different types of firearms, the information may be used in a rifle scope or other optical device configurable to couple to a firearm. One possible example of an optical device implemented as a rifle scope coupled to a rifle is described below with respect to FIG. 3.

Figure 3:
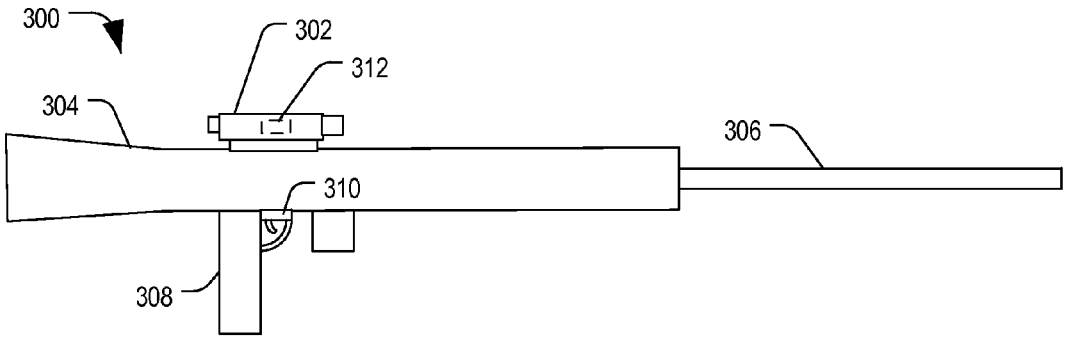
FIG. 3 is a diagram of a firearm system including an optical device configured to track a number of shots fired and to determine a muzzle velocity from a life-cycle profile for a particular firearm based on the number of shots fired as an input to a ballistic solution.

FIG. 3 is a diagram of a firearm system 300 including an optical device 302 configured to track a number of shots fired and to determine a muzzle velocity parameter from a life-cycle profile for a particular firearm 304 based on the number of shots fired with the result used as an input to a ballistic solution. Optical device 302 is coupled to firearm 304, which includes a barrel 306, a grip 308, and a trigger assembly 310. Optical device 302 includes circuitry 312 including, but not limited to, a display, optical sensors, rangefinder circuitry, image processing circuitry, a shot detector, and a memory. Circuitry 312 is configured to capture images of a view area of optical device 302 and to present images corresponding to at least a portion of the view area to the display. Further, circuitry 312 is configured to track the number of times that the firearm 304 has been fired ("shot count"). The memory may be configured to store the shot count. In response to a user input, such as cycling of a bolt of firearm 304, selection of a button on optical device 302, or selection of a target (in the case of a precision guided firearm), circuitry 312 retrieves the shot count, determines the muzzle velocity parameter corresponding to the shot count from a life-cycle profile stored in the memory, and uses the muzzle velocity parameter as an input to a ballistics solution.

While a rifle is shown, it should be appreciated that other types of weapons may also be profiled and the optical device 302 may be configured to operate with various weapons. In an example, optical device 302 may include one or more input/ output (I/O) ports for receiving a life-cycle profile for a particular type of firearm to which the optical device 302 is to be mounted. Thus, optical device 302 can be mounted to a variety of firearms and configured with an appropriate life-cycle profile for the particular firearm to which it is mounted. One possible example of an implementation of optical device circuitry 312 is described below with respect to FIG. 4.

Figure 4:
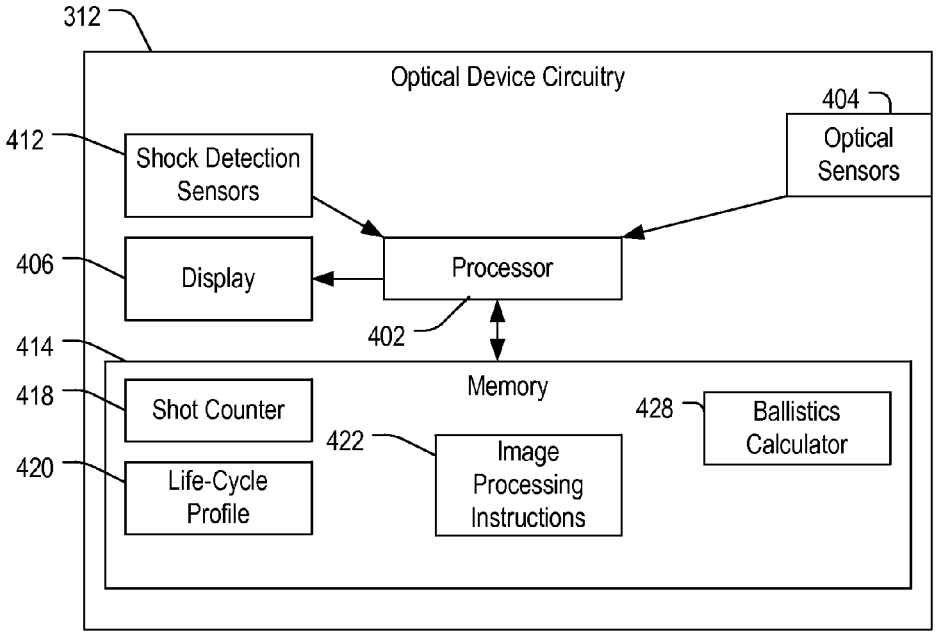
FIG. 4 is a block diagram of the optical device of FIG. 3.

FIG. 4 is a block diagram of the optical device circuitry 312 of FIG. 3. Optical device circuitry 312 includes a processor 402 coupled to one or more optical sensors 404 and to a display 406. Processor 402 is also coupled to shock detection sensors 412, which may include a piezoelectric element configured to generate a signal in response to a shock event. Processor 402 may be configured to detect a shot based on a signal shape or signature that differs from a signal corresponding to a drop or other shock event. Circuitry 312 may also include a memory 414 that is coupled to processor 402.

Memory 414 includes a shot counter 418 configured to store a shot count (i.e., a number of shots fired) for the associated firearm to which optical device 302 is mounted. Memory 414 further includes a life-cycle profile 420 for the firearm. Memory 414 also includes image processing instructions 422 that, when executed by processor 402, causes processor 402 to process image data captured by optical sensors 404 and to provide the image data to display 406. Memory 414 also includes a ballistics calculator 428 that, when executed, causes processor 402 to calculate a ballistics solution. Further, processor 402 may retrieve the shot count from shot counter 418, determine a corresponding muzzle velocity parameter from life-cycle profile 420 based on the shot count, and provide the muzzle velocity parameter as an input to ballistics calculator 428.

Figure 5:
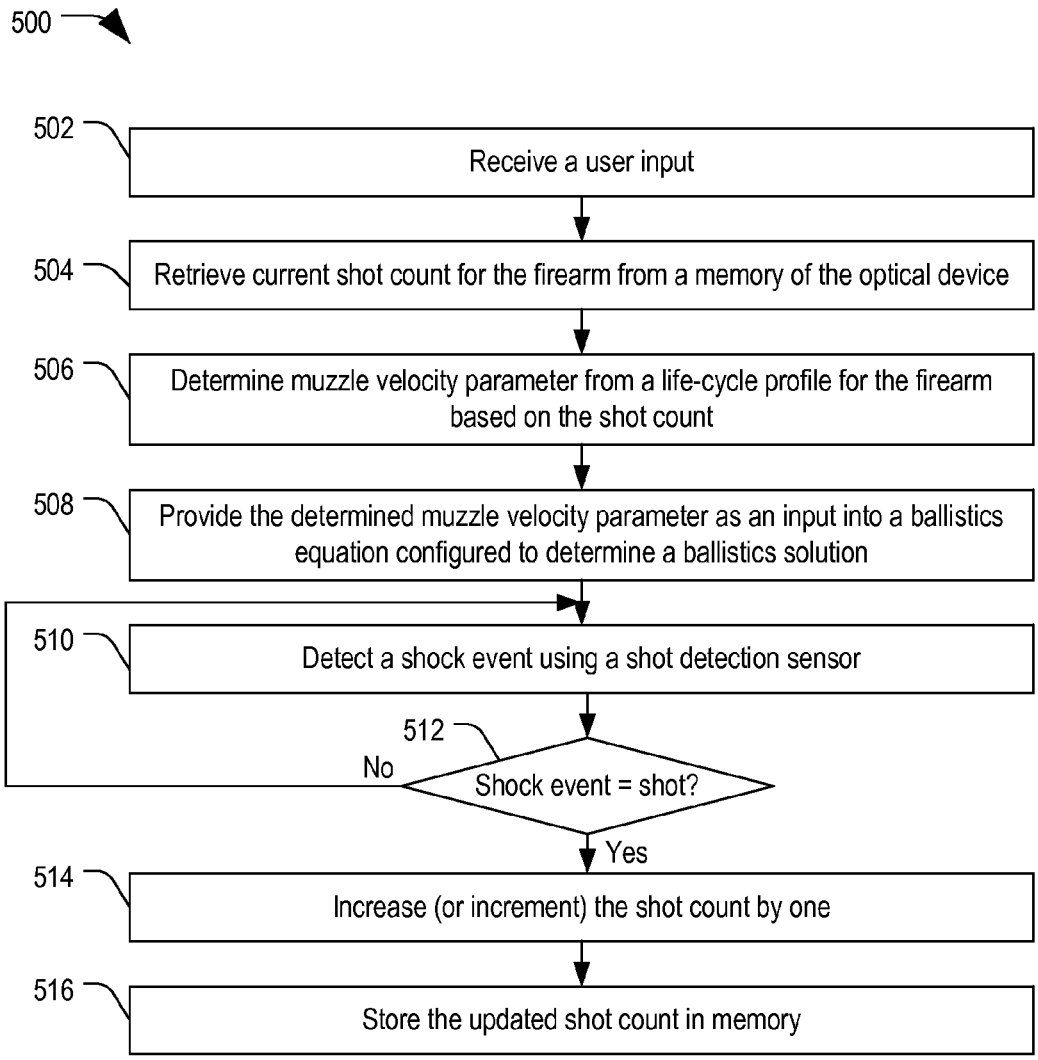
FIG. 5 is a method of determining an input to a ballistic solution from a life-cycle profile of a firearm based on a number of shots fired.

FIG. 5 is a method 500 of determining an input to a ballistic solution from a life-cycle profile of a firearm based on a number of shots fired. At 502, user input is received. The user input may include any input or action by a user that would initiate the determination of a ballistics solution. Such user input may include a user request for an updated ballistics solution through interaction with one or more buttons on a scope. Alternatively, such user input may include bolt cycling of the gun, which bolt cycling initiates calculation of a ballistics solution. In another embodiment, such user input includes selection of a target by a user using, for example, buttons on a precision guided firearm system.

Continuing to 504, the optical device retrieves a shot count for the firearm from a memory. The shot count is a numeric value indicating the number of times that the firearm has been fired or shot. Proceeding to 506, the optical device determines a muzzle velocity parameter from a life-cycle profile for the firearm based on the shot count. In an example, a processor of the optical device identifies a muzzle velocity on a graph or within a table based on the shot count. In another example, the processor calculates the muzzle velocity based on an algorithm using the shot count.

Moving to 508, optical device provides the determined muzzle velocity parameter as an input into a ballistic equation configured to determine a ballistics solution. Other factors may also weigh into the ballistics solution, including range, environmental parameters, ballistics type, and so on.

Continuing to 510, shock detection sensor 412 detects a shock event. The shock event may be caused by dropping firearm 304. Alternatively, the shock event may be caused by discharge of the firearm. In a particular example, shock detection sensor 412 includes a piezoelectric element that produces a signal in response to the shock event. A shot or discharge of the firearm may have a particular signal profile or signature that is different from that produced by other types of shocks.

Proceeding to 512, if the shock event does not produce a signal that corresponds to a shot, the method 500 returns to 510 to wait for detection of a shock event. At 512, if the shock event corresponds to a shot, the method 500 continues to 514 and the shot count is increased or incremented by one. Advancing to 516, the updated shot count is stored in memory 414.

In general, the method 500 is provided for illustrative purposes only. Changes may be made in the order of the blocks, and some blocks or elements may be combined and/or omitted without departing from the scope of this disclosure. In an alternative embodiment, the shot count may be stored in memory 414 after several shots have been fired, rather than after each shot.

In conjunction with the systems and methods described above with respect to FIGS. 1-5, an optical device is configured to be mounted to a firearm and to count each shot taken using the firearm. The optical device includes a memory configured to store the shot count and a life-cycle profile. The optical device further includes a processor configured to retrieve the shot count and to retrieve a muzzle velocity parameter from the life-cycle profile based on the shot count. The processor provides the muzzle velocity parameter as an input to the ballistics solution. The muzzle velocity parameter may be the muzzle velocity corresponding to a particular shot count, a difference in the muzzle velocity from one shot to the next, or a value calculated from one of the muzzle velocity and the difference.

Although the present invention has been described with reference to preferred embodiments, workers skilled in the art will recognize that changes may be made in form and detail without departing from the scope of the invention.

What is claimed is:

1. A method comprising: determining a shot count within an optical device coupled to a firearm, the shot count corresponding to a number of shots taken using the firearm; and determining a muzzle velocity parameter from a life-cycle profile of the firearm based on the shot count; and adjust a ballistics solution according to the determined muzzle velocity.

2. The method of claim 1, further comprising:

receiving a user input; and determining the shot count in response to receiving the user input.

3. The method of claim 2, wherein the user input comprises at least one of a user request for an updated ballistics solution and a bolt-cycling event.

4. The method of claim 1, further comprising:

detecting a shot; and incrementing a shock counter that maintains the shot count in response to detecting the shot.

5. The method of claim 1, wherein detecting the shot comprises:

generating a signal in response to a shock event; and detecting the shot when the signal matches a characteristic profile representing discharge of the firearm.

6. The method of claim 1, wherein determining the muzzle velocity parameter comprises looking up the muzzle velocity parameter corresponding to the shot count in a look up table storing values corresponding to the life-cycle profile of the firearm.

7. The method of claim 1, wherein determining the muzzle velocity parameter comprises calculating the muzzle velocity parameter based on the shot count.

8. An optical device configured to be mounted to a firearm, the optical device comprising: a processor; and a memory accessible to the processor and configured to store a shot count corresponding to a number of times the firearm has been discharged and to store a life-cycle profile corresponding to the firearm, the memory accessible to the processor and including instructions that, when executed, cause the processor to determine the shot count and to determine a muzzle velocity parameter of the firearm from the life-cycle profile based on the shot count, and adjust a ballistics solution according to the determined muzzle velocity.

9. The optical device of claim 8, wherein the life-cycle profile comprises a table including an average muzzle velocity versus number of shots for a type of the firearm.

10. The optical device of claim 9, wherein the processor determines the muzzle velocity parameter by retrieving the average muzzle velocity from the life-cycle profile that corresponds to the shot count.

11. The optical device of claim 8, further comprising:

a shot detection sensor coupled to the processor and configured to generate a signal in response to a shock event; and wherein the memory further includes instructions that, when executed, cause the processor to detect a shot when the signal matches a shot characteristic and to increment the shot count in response to detecting the shot.

12. The optical device of claim 8, wherein the life-cycle profile comprises a curve-fitting algorithm derived from muzzle velocity versus shot count for at least one firearm of a type corresponding to the firearm.

13. The optical device of claim 8, further comprising an input/output interface coupled to the processor and configured to receive the life-cycle profile.

14. The optical device of claim 13, wherein the processor receives the life-cycle profile and stores the life-cycle profile in the memory.

15. A rifle scope comprising: a processor; and a memory accessible to the processor and configured to store a shot count, the memory configured to store instructions that, when executed, cause the processor to determine the shot count, determine a muzzle velocity parameter from a life-cycle profile in response to determining the shot count, and adjust a ballistic solution according to the determined muzzle velocity.

16. The rifle scope of claim 15, further comprising:

a shot detection sensor coupled to the processor and configured to generate a signal in response to a shock event; and wherein the memory stores instructions that, when executed, cause the processor to determine when the signal corresponds to a shot and to increment the shot count in response to detecting the shot.

17. The rifle scope of claim 15, wherein the shot detection sensor comprises a piezoelectric element.

18. The rifle scope of claim 15, wherein the life-cycle profile comprises a table of muzzle velocities, each of the nui7zle velocities corresponding to a number of shots fired.

19. The rifle scope of claim 15, wherein the life-cycle profile comprises a curve-fitting algorithm, the processor configured to calculate the muzzle velocity based on the shot count using the curve-fitting algorithm.

20. The rifle scope of claim 15, wherein the processor is configured to receive a user input and to determine the shot count in response to the user input.

* * * * *